United States Patent [19]

Linkowski

[11] 4,119,360

[45] Oct. 10, 1978

[54] A.C. INTERLOCK PLUG, CONTACT AND METHOD

[75] Inventor: Stanley A. Linkowski, Franklin Park, Ill.

[73] Assignee: Chromalloy Alcon, Inc., Chicago, Ill.

[21] Appl. No.: 711,440

[22] Filed: Aug. 4, 1976

[51] Int. Cl.[2] ..... H01R 9/16

[52] U.S. Cl. ..... 339/217 S; 29/629; 29/630 R; 339/221 M

[58] Field of Search ..... 339/217 S, 221; 29/629, 29/630 R, 630 D

[56] References Cited

U.S. PATENT DOCUMENTS

| | | | |
|---|---|---|---|
| 2,231,347 | 2/1941 | Reutter | 339/221 R |
| 2,337,692 | 12/1943 | Todd | 339/221 M |
| 2,685,072 | 7/1954 | Berman | 339/217 TP |
| 3,579,178 | 5/1971 | Travis | 339/221 R |

FOREIGN PATENT DOCUMENTS

| | | | |
|---|---|---|---|
| 1,213,310 | 10/1959 | France | 339/217 S |

*Primary Examiner*—Joseph H. McGlynn
*Assistant Examiner*—Mark S. Bicks
*Attorney, Agent, or Firm*—Hill, Gross, Simpson, Van Santen, Steadman, Chiara & Simpson

[57] ABSTRACT

An electrical connector of the type known in the television industry as A.C. interlock plug, comprises a dielectric body having opposite faces and an opening extending therethrough and through both of the opposite faces. A contact member having a pin body and a solder lug extending from one end of the body, has the solder lug projecting through the opening, a shoulder on the pin body engaging the dielectric body as a stop and spur means on the solder lug retainingly engaging with the dielectric body to prevent withdrawal of the contact member.

The contact member may be formed up from sheet metal into a tubular pin body and a transversely arcuately reinforced solder lug on which the spur means comprise one or more shear formed pointed projections along the edges of the solder lug.

11 Claims, 9 Drawing Figures

A.C. INTERLOCK PLUG, CONTACT AND METHOD

The contact member may be formed up from sheet metal into a tubular pin body and a transversely arcuately reinforced solder lug on which the spur means comprise one or more shear formed pointed projections along the edges of the solder lug.

In assembling the contact member with the dielectric body, the solder lug is inserted into the preformed opening in the dielectric body through the principal face of the dielectric body until the pin body shoulder stops against the dielectric body, and the spur means slide easily into the preformed opening but positively bitingly engage the dielectric body against withdrawal of the contact member. This invention relates to electrical connectors, and is more particularly concerned with that type of connector referred in the television industry as an A.C. interlock plug.

Electrical connectors of the type indicated have heretofore been provided with contact members of the combination pin and solder lug type formed from heavy gauge wire or rod stock wherein the pin portion of the connector remains at the original diameter of the stock, and the solder lug portion is a flattened extension from the pin portion. In effecting the flattening, the width dimension of the solder lug portion becomes wider than the diameter of the pin portion, defining shoulders which face in the direction of projection of the pin portion. Assembly of the contact members with dielectric bodies of the connectors is effected by directing the pin portions tip end first into and through preformed complementary cylindrical holes and continuing the assembly until the shoulders stop the relative assembly movement. To prevent the contact members from backing out or away when the interlock plug is joined to a complementary interlock jack, the pin portions of the contact members have been provided with laterally upset ears which are gouged in the walls defining the respective receiving holes in the dielectric body. Not only does this require great force to drive the anchoring ears into the material of the dielectric body, but there is also a fracturing and displacement of material by the anchoring ears which tends to weaken the grip in the dielectric body to resist the sometimes considerable frictional resistance pressure when the interlock plug contacts are mated with the interlock jack assemblies of the interlock couplings provided for this type of connector. There is a tendency for the plug contact members to be pushed back in reverse to the direction in which the contact members were assembled with the dielectric body of the container.

Because the solder lug portions of the contact members are coaxial with the pin portions, the solder lugs of adjacent fairly closely spaced contact members leave very little room for soldering leads to the solder lugs, and inadequate and electrically detrimentally insufficient clearance may result.

Due to the mass of metal in the contact members derived from solid rod or wire stock, the solder lugs require so much heat for effective soldering that there is a tendency to cause overheating and deterioration of the plastic material of the dielectric body of the connector in the vicinity of the contact members.

An important object of the present invention is to provide a new and improved electrical connector, contact member structure and method which will overcome the disadvantages, deficiencies, inefficiencies, shortcomings and problems of prior electrical connectors, and more particularly connectors of the A.C. interlock type.

Another object of the invention is to provide new and improved contact structure in electrical connector plug assemblies which will attain satisfactory cost reduction as compared to prior connectors of this type.

A further object of the invention is to provide new and improved contact members for electrical connectors.

Still another object of the invention is to provide contact members of substantially greater efficiency than prior contact members intended for substantially the same purpose.

Yet another object of the invention is to provide a new and improved method of making electrical connectors.

A still further object of the invention is to provide a new and improved method of making contact members for electrical connectors.

According to features of the invention there is provided an electrical connector comprising a dielectric body having a major face and an opposite face and an opening extending through the body and through both of the faces, an electrically conductive contact member having a body pin and a solder lug of substantial length extending from one end of the pin and pushed through the opening from the major face and extending from said opposite face of the dielectric body, the pin and the dielectric body having shoulders at said principal face limiting the extent of projection of the solder lug through the opening, and retention spur means on the solder lug spaced from the shoulders and projecting generally in the same direction as the pin projects from the solder lug and engaging the dielectric body for holding the solder lug against withdrawal from the body.

According to other features of the invention, there is provided an electrical contact member which may be formed up from sheet metal; and a method of making the contact member and a connector using the contact member.

Other objects, features, and advantages of the invention will be readily apparent from the following description of certain representative embodiments thereof, taken in conjunction with the accompanying drawing although variations and modifications may be effected without departing from the spirit and scope of the novel concepts embodied in the disclosure, and in which.

Figure 1:
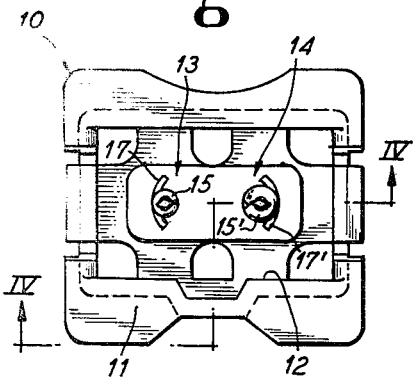
FIG. 1 is a top plan view of a connector embodying features of the invention.
Figure 2:
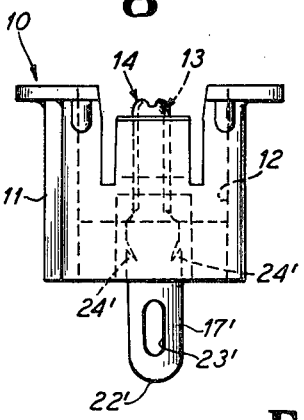
FIG. 2 is an end elevational view of the connector.

On reference to FIGS. 1–4, an electrical connector 10 of the type known in the television industry as an A.C.

interlock plug comprises a dielectric body 11 formed from a suitable plastic material such as polyester cast into the desired form usual for this part and provided with a cavity 12 into which a jack member (not shown) is received and having female sockets within which one or more, and as shown two, pin type contact members 13 and 14 carried by the body 11 are received in electrical connection. Pin portions of the contacts 13 and 14 project from one face of the body 11, and which face may be considered the major face which is at the bottom of the cavity 12, while solder lug portions of the contacts project from the opposite or back face of the body.

According to the present invention, each of the contact members 13 and 14 is formed up from suitable sheet metal such as brass. In a construction wherein the contact members 13 and 14 are of substantially 1-inch in overall length the material may comprise 0.018-inch thick brass sheet or strip. After forming, the contact members may be suitably plated if desired. Although each of the contact members 13 and 14 may be identical, the pin diameter may be different to suit particular requirements. The basic structure of the contact members 13 and 14 is preferably the same. As shown, the contact member 13 has a body pin 15 of smaller diameter than the body pin 15' of the contact member 14. In a typical relationship, the body pin 15 may be about 0.092-inch in diameter and the body pin 15' may be about 0.139-inch diameter. Integral with and extending in the opposite direction from the body pin 15 is a solder lug 17, and similarly extending from the body pin 15' of the contact member 14 is a solder lug 17'. Although the body pins 15 and 15' may be of different diameters, the solder lugs 17 and 17' may be of substantially the same construction, both of substantially the same width and length and formed on the same radius substantially greater than the radius of the pin diameters so that although the pins and the solder lugs have medium continuous longitudinal surfaces, the solder lugs flare to opposite sides beyond the outside diameter of the associated pin substantially as a pair of wings. The arcuate transverse structure of the solder lugs 17 and 17' substantially reinforces them against bending out of shape, that is they are of substantial stiffness so as to facilitate handling and assembly with the body 11.

Figure 7:
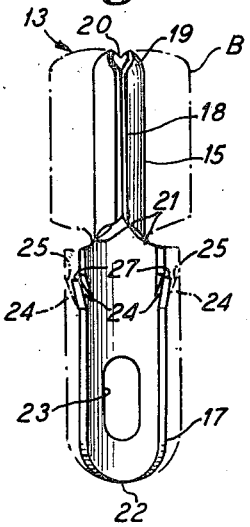
FIG. 7 is a face elevational view of one of the contact members.
Figure 8:
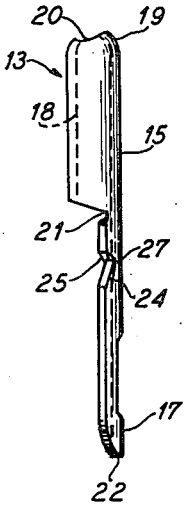
FIG. 8 is a side elevational view of the contact member.
Figure 9:
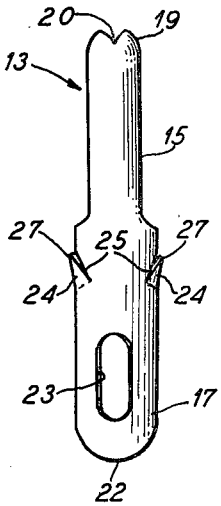
FIG. 9 is an elevational view from the opposite face of the contact member.

In a typical construction as depicted in FIGS. 7, 8 and 9, having reference to the contact member 13 by way of example, suitable progressive die stamping and forming is a preferred technique for making the contact member. To this end, a metal blank B of the desired material is shaped to provide the body pin 15 and the integral solder lug 17. The pin portion of the blank is bent about alongitudinal axis into the desired preferably cylindrical tube shape for the pin 15, the side edges of the pin portion of the blank being brought together at a longitudinal joint 18. At its tip 19 the pin body portion 15 is substantially uniformly rounded for leadin facility in mating and projection into a jack socket. At the extremity of the tip 19, the joint is preferably left open and provides a vent hole 20 which facilitates both insertion of the pin into a socket and withdrawal of the pin by permitting free air flow and thus preventing air compression resistance to insertion into a socket and suction resistance during withdrawal from the socket and assuring that resistance encountered is the result of firm electrical contact between the pin and the walls of the socket. Adjacent to juncture with the solder lug 17, the pin 15 has a shoulder 21 which desirably slopes away from the juncture so that at the juncture the shoulder is reasonably accurately controlled with respect to the length of the pin between the shoulder and the tip 19 of the pin, and any manufacturing tolerances which may occur in the shoulder beyond the juncture area will not interfere with substantially accurate and firm seating of the shoulder on the connector body in the assembly.

On its distal end, the solder lug 17 is preferably formed with a generally rounded spade tip 22 which will facilitate assembling the solder lug with the connector body. As is usual, the solder lug 17 is provided with an eye 23 to facilitate soldering a lead terminal to the solder lug. As shown, the solder lug 17 has substantially straight parallel longitudinal side edges extending from the pin end of the solder lug toward the distal or free end of the solder lug and at opposite sides of the broad face surfaces of the solder lug. In addition, the solder lug 17 is provided with means comprising one or more retention spurs 24 inside the straight side edges. In a preferred form, these spurs are shear formed simply by shearing along separations 25, the shear lines extending diagonally inwardly from the longitudinal substantially straight side edges of the solder lug and then slightly bendably deflecting the spurs from the normal cross sectional shape of the solder lug, in the preferred form displacing the spurs with their sharp tips 27 extending from the convex broad surface face of the solder lug and projecting generally in the direction of extension of the pin 15 from the solder lug. In a preferred construction the distance to which the tips 27 are deflected from the arcuate plane of the convex face is about the thickness of the material or slightly less. For example, where the member is of 0.018 thickness material the deflection of the tips 27 at their outer sides may be about 0.015 inch. It will be observed that the tips 27 of the spurs are spaced from the shoulder 21. In a typical construction where the length of the pin 15 from the tip 19 to the shoulder 21 at juncture with the solder lug 17 is about 0.410-inch, and the solder lug 17 is 0.530-inch in length, the prongs 24 may be about 0.062-inch in length and the tips 27 may be spaced from the juncture area of the shoulder 21 about 0.078-inch.

Figure 3:
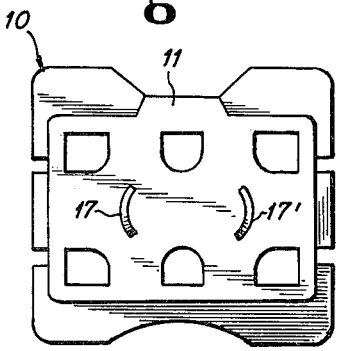
FIG. 3 is a bottom plan view of the connector.
Figure 4:
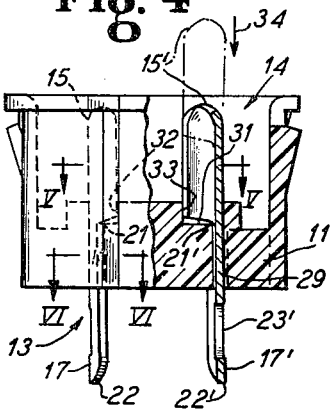
FIG. 4 is a sectional elevational view taken substantially along the line IV—IV of FIG. 1.
Figure 5:
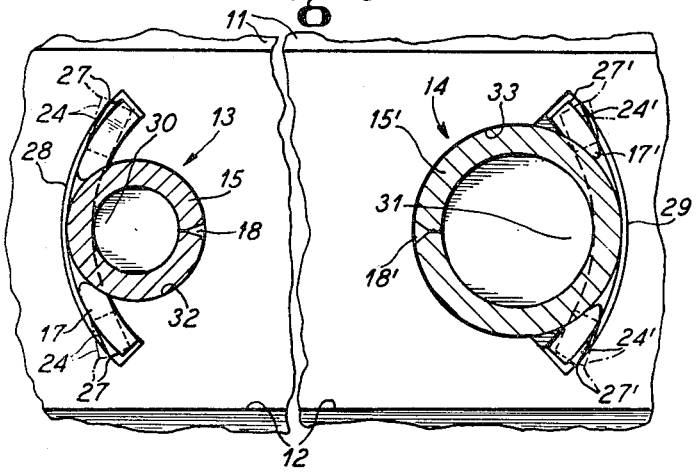
FIG. 5 is a substantially enlarged fragmental sectional elevational view taken substantially along the line V—V of FIG. 4.
Figure 6:
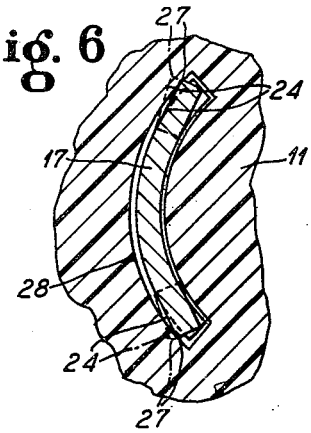
FIG. 6 is a fragmentary sectional detail view taken substantially along the line VI—VI of FIG. 4.

By constructing the electrical contact members 13 and 14 as described, assembly with the dielectric connector body 11 is adapted to be effected easily, quickly and with utmost efficiency by simple relative assembly movement wherein the solder lugs 17 and 17' are simply inserted into and relatively pushed through respective receiving holes 28 and 29 (FIGS. 1, 3 and 5). As best seen in FIG. 5, the receiving holes 28 and 29 are shaped complementary in cross section to the solder lugs 17 and 17'. That is, each of the holes 28 and 29 is preferably of substantially the same arcuate cross section as the solder lugs, with just enough clearance to permit easy sliding assembly of the solder lugs into and through the holes. For example, where the solder lugs 17 and 17' are of 0.018-inch thickness and about 0.180 in width, the holes 28 and 29 are of about 0.022-inch in the thickness direction and about 0.186 in the width direction. Therefore, insertion of the tips 22 and 22' of the solder lugs 17 and 17' respectively, into the major face ends of the holes 28 and 29 is quite free from any resistance, and it is not until the spurs 24 and 24' make contact with the dielectric body 11 that any resistance to insertion of the solder lugs is encountered. Such resistance does not occur until the solder lugs are almost fully inserted through the openings 28 and 29 and project beyond the opposite face of the body 11 because the spurs 24 and 24' are adjacent to the pin ends of the solder lugs. Then, driving in of the electrical contact members 13 and 14 to fully assembled relation is thrust resisted only minimally because the back surfaces of the generally triangularly shaped spurs 24 and 24' serve to cam the spurs fairly smoothly from their fully extended position indicated in dash outline in FIG. 5 to the full line position shown. This does not require much force because the spurs are of relatively small mass and therefore sufficiently resilient to yield the narrow range required to permit entry into the respective holes 28 and 29. The transversely arcuate reinforced structure of the solder lugs 17 and 17', especially adjacent to the pins 15 and 15' and the substantial continuity and connection of the pin portions of the contact members with the solder lugs assures adequate longitudinal stiffness to permit all the longitudinal driving force necessary to drive the contact members fully home in the assembled relation in the connector body 11. Such fully assembled position is attained when the shoulders 21 and 21' engage respective shoulders 30 and 31 on the major face of the connector body 11 adjacent to the holes 28 and 29 respectively. In a preferred construction, the shoulder 30 is located at the bottom of a shallow socket recess 32 substantially complementary to the inner end portion of the pin 15 and serving as a stabilizing support for the pin. Similarly, the shoulder 31 is located at the bottom of a shallow socket recess 33 and is of complementary cylindrical form to serve as a stabilizing support for the inner end portion of the pin 15'. In the fully seated position of the pin shoulders 21 and 21' in the respective sockets, where the thickness of the connector body 11 between the bottom of the sockets and the back face of the connector body is about 0.215-inch, about 0.315-inch of the solder lugs will project beyond the connector body and sufficiently to fully clear the solder eyes 23 and 23'. By having the transversely arcuate holes 28 and 29 located with the convex dimensions facing toward one another, although the contact members 13 ad 14 are in transverse alignment in the connector assembly, the confrontation of the convex faces of the solder lugs 17 and 17' provides maximum spacing therebetween to facilitate soldering operations, even though the spacing between the pins 15 and 15' is substantially less, as may be readily visualized in FIGS. 1 and 4. In addition, because the solder lugs 17 and 17' are formed from relatively thin sheet metal of uniform section, only minimal heat transfer to the dielectric connector body occurs during soldering, and well below damaging temperature.

In the final assembled positions of the electrical contact members 13 and 14, the spur points 27 and 27' engage in positive retaining, anchoring relation with the dielectric body 11 to hold the solder lugs against withdrawal from the body. Any withdrawal force applied to either of the contact members causes the sprur tips to dig into and prevent any significant withdrawal movement of the respective contact members. It will thus be appreciated that not only are the contact members 13 and 14 assembled with the connector body 11 by pushing the contact members in the direction of the arrow 34 in FIG. 4 and as represented by the dot-dash outline of the contact member to the full line position of the contact member, the assembly movement being toward the solder lug, which is the same direction as the force which may be encountered by the contact pins during assembly with a mating connector element, but in separating the connector elements separating pull on the pins is thoroughly resisted by the spurs 24 and 24'. Thus it is easy to assemble the contact members 13 and 14 with the body 11, but virtually impossible short of destruction to separate the contact members from the connector body. Not only do the prongs 24 and 24' provide the positive anchorage for this purpose, but they also serve to maintain a snug engagement of the conduct members with the connector body, and substantially free from any lateral looseness, by exerting a transverse spring bias which forces the convex faces of the solder lugs against the complementary wall of the associated assembly holes 28 or 29, as the case may be. This biasing effect is transmitted also to the socketed inner end portions of the pins 15 and 15', thrusting the same against the walls defining the sockets 32 and 33 opposite the holes 28 and 29, respectively.

It will also be apparent that by virtue of the constructions and method of assembly of the contact members 13 and 14 with the connector body 11, quite accurate axial orientation of the pins 15 and 15' is assured, thus facilitating coupling with a mating connector assembly.

It will be understood that variations and modifications may be effected without departing from the spirit and scope of the novel concepts of this invention.

I claim as my invention:

1. An electrical connector comprising:

a dielectric body having a major face and an opposite face and a contact member mounting passage hole of slot-like form in transverse cross section with narrowly spaced opposite surfaces and substantially spaced apart longitudinal edges, the hole extending through said body and opening from both faces of the body;

an electrically conductive contact member having an elongate pin portion and a solder lug of substantial length extending from one end of said pin portion;

said solder lug being in pushed assembly with said body and extending through said hole from said major face and projecting from said opposite face of the body;

said pin portion having shoulder means at its said one end and said body having a shoulder at said major face, said shoulders being in confrontation and limiting the extent of projection of said solder lug through said opening and maintaining said pin portion projecting from said major face;

said solder lug being substantially complementary in transverse cross section to said slot-like hole and thus thin between opposite broad surfaces of the solder lug but of substantial width between longitudinal side edges of the solder lug;

said solder lug having substantially straight parallel longitudinal side edges extending from the pin end of the solder lug toward the free end of the solder lug;

shear formed retention spur projections of substantially triangular shape formed in said solder lug entirely within said longitudinal substantially straight side edges, each of said spur projections having a sharp tip point spaced from said pin portion shoulder and extending generally in the same direction as said pin portion projects from said solder lug;

each of said spur projections being partially separated from the solder lug along a shear line extending away from said shoulder means diagonally inwardly from the longitudinal substantially straight side edge within which the spur projection is formed;

each of the spur projections being deflected from the normal cross section of the solder lug and generally diagonally across the plane of one of the broad width surfaces of the solder lug whereby the spur projections remain inside said longitudinal substantially straight edges and are adapted to cam along the surface of said hole which opposes said one broad width surface of the solder lug when the solder lug is pushed through the hole in assembling the contact member with the dielectric body; and said spur projection points engaging in positive retaining, anchoring relation with said opposing dielectric body hole surface whereby to dig into said surface of the hole and hold the solder lug and thereby the contact member against withdrawal from the dielectric body by forces exerted on the pin portion in a direction away from said major face, while said shoulders provide positive retention of the contact member in position on the dielectric body against forces acting on the pin portion toward said major face.

2. An electrical connector according to claim 1, wherein said hole and said solder lug are of complementary transversely arcuate section, said dielectric body having a second contact member mounting passage hole therethrough spaced from the first mentioned hole, and a second contact member of substantially the same structure as said first mentioned contact member and having a solder lug of transverse arcuate cross section complementary to said second hole and extending from a body pin through said second hole and extending from said opposite face of the dielectric body, said solder lugs having the concave faces thereof facing toward one another.

3. An electrical connector according to claim 1, wherein said hole is of arcuate cross section, said solder lug being of complementary arcuate cross section to said hole, and said one surface of the solder lug being transversely convex with said spur projections extending therefrom into anchoring relation of said spur projection points with said surface of the hole.

4. An electrical connector according to claim 3, wherein said pin portion is of hollow tubular form and said solder lug comprises an extension in line with a chordal portion of the pin perimeter and has longitudinally straight edged wing-like side portions extending beyond the diameter of the pin, said spur projections being on said side portions.

5. An electrical connector according to claim 1, wherein said major face has a cavity therein and a socket depressed in said cavity and aligned with said opening and receptive of the pin portion adjacent to juncture with the solder lug, said socket having said shoulder of the body.

6. An electrical connector according to claim 5, wherein said spur projections also function as take up biasing means maintaining the contact member tightly in position in said hole.

7. A method of making an electrical connector assembly of the A.C. interlock plug type, comprising:

forming a dielectric connector body with a major face and an opposite face;

forming a contact mounting hole of slot-like cross sectional shape in said body and providing said hole with opposite surfaces of major width between opposite substantially straight longitudinal edges defining the hole and with an entry end of the hole at said major face and an opposite end at said opposite face;

forming a contact member from electrically conductive material and providing the contact member with a body pin portion and a solder lug of complementary cross sectional shape to said hole and extending integrally in alignment from one end of the pin and of greater length than the hole;

providing said one end of the pin portion with a stop shoulder facing in the same direction as the solder lug extends from the pin;

shaping said solder lug with opposite broad width surfaces complementary to said mounting hole surfaces and providing the solder lug with substantially straight parallel longitudinal side edges extending from the pin end of the solder lug toward the free end of the solder lug;

shear forming retention spur projections of substantially triangular shape in said solder lug entirely within said longitudinal substantially straight edges by partially separating the spur projections from the solder lug along respective shear lines extending away from said shoulder means diagonally inwardly from the longitudinal substantially straight side edge within which the spur projection is formed; in a direction away from the major face, while said shoulders provide positive retention of the contact member in position on the dielectric body against forces acting on the pin portion toward said major face.

8. A method according to claim 7, comprising forming said dielectric body with a cavity and a seating socket in said cavity aligned with said opening at said major face, and receiving the inner end portion of the pin in said socket.

9. A method according to claim 7, comprising forming said dielectric body with a second slot-like mounting hole in spaced parallel relation to said first mentioned mounting hole and the second hole having an end at said major face and its opposite end at the opposite face of the body, forming both of said holes in transversely arcuate form and with the concave dimensions of the holes directly opposite and facing toward one another, forming a second contact member with a pin portion and a solder lug extending from one end of the pin portion, forming both of said solder lugs of transversely arcuate form complementary to the transverse arcuate form of said holes, shear forming spur projections of generally triangular sharp tip point shape on each of said solder lugs entirely inside longitudinal straight edges along the sides of the solder lugs, deflecting the spur projections to extend diagonally from said arcuate surfaces of the solder lugs and orienting the tip points to project in generally the direction of projection of the pin portions from the solder lugs, inserting the solder lug of said second contact member into said second hole, in addition to inserting of the solder lug of the first mentioned contact member into the first mentioned hole, and projecting both of the solder lugs beyond said opposite face of the dielectric body with their concave faces opposite one another, and effecting biting retention of said tip points with arcuate surfaces of said holes.

10. For use in an electrical connector, an electrically conductive contact member comprising:

an elongate pin portion and a solder lug of substantial length extending from one end of said pin portion;

said solder lug being adapted for pushed assembly with a dielectric body to extend through a hole in the body from a major face of the body and to project from an opposite face of the body;

said pin portion having shoulder means at its said one end for stopping opposition against a shoulder of the major face of the dielectric body to limit the extent of projection of the solder lug through said opening and to maintain the pin portion projecting from said major face;

said solder lug being of a cross section which is thin between opposite broad surfaces of the solder lug but of substantial width between longitudinal side edges of the solder lug;

said solder lug having substantially straight parallel longitudinal side edges extending from the pin end of the solder lug toward the free end of the solder lug;

shear formed retention spur projections of substantially triangular shape formed in said solder lug entirely within said longitudinal substantially straight side edges, each of said spur projections having a sharp tip point spaced from said pin portion shoulder and extending generally in the same direction as said pin portion projects from said solder lug;

each of said spur projections being partially separated from the solder lug along a shear line extending away from said shoulder means diagonally inwardly from the longitudinal substantially straight side edge within which the spur projection is formed;

each of the spur projections being deflected from the normal cross section of the solder lug and generally diagonally across the plane of one of the broad width surfaces of the solder lug whereby the spur projections remain inside said longitudinal substantially straight edges and are adapted to cam along the surface of said hole which opposes said one broad width surface of the solder lug when the solder lug is pushed through the hole in assembling the contact member with the dielectric body;

said spur projection points being adapted to engage in positive retaining anchoring relation with said opposing dielectric body hole surface whereby to dig into said surface of the hole and hold the solder lug and thereby the contact member against withdrawal from the dielectric body by forces exerted on the pin portion in a direction away from said major face, while said shoulders provide positive retention of the contact member in position on the dielectric body against forces acting on the pin portion toward said major face;

said solder lug being of arcuate cross section;

and said retention spur projections being displaced angularly from and across the arcuate plane of said one broad surface of the solder lug.

11. A method of making an electric contact member for assembly with a dielectric connector body having a complementary hole therethrough for assembly of the contact member with the dielectric body, the steps including:

shaping a sheet metal blank into an elongate pin portion and a solder lug of substantial length extending from one end of said pin portion;

providing said one end of the pin portion with a stop shoulder facing in the same direction as the solder lug extends from the pin portion so that when the solder lug is pushed into assembly with a dielectric body having a complementary hole therethrough to receive the solder lug said shoulder will make stopping engagement with a shoulder on the dielectric body to limit the extent of projection of said solder lug through the opening;

shaping said solder lug to be of substantial length and of substantial width with substantially straight parallel longitudinal side edges extending from the pin end of the solder lug toward the free end of the solder lug, and with a relatively thin cross section between said substantially straight edges and providing opposite broad surfaces across said width;

shear forming retention spur projections of substantially triangular shape in said solder lug entirely within said longitudinal substantially straight side edges;

effecting said shear forming along a shear line for each of said spur projections extending away from said shoulder means diagonally inwardly from the longitudinal straight side edge within which the spur projection is formed and thereby forming on the spur projection a sharp tip point spaced from said pin shoulder and extending generally in the same direction as said pin portion projects from said solder lug;

partially separating each of said spur projections along said shear line and deflecting each of the spur projections from the normal cross sectional shape of the solder lug and at a generally diagonal angle which extends across and out of the plane of one of the broad width surfaces of the solder lug and inside said longitudinal substantially straight edges so as to permit camming of the spur projections along the surface of the hole of the dielectric body into which the solder lug is projected and the spur projection points can then engage in positive retaining, anchoring relation with the hole surface of the dielectric body which opposes said one broad surface of the solder lug and by digging into such hole surface retain the solder lug and the contact member against withdrawal from the dielectric body;

shaping said solder lug into transversely arcuate form;

and deflecting said spur projections to extend diagonally from an arcuate surface of the solder lug.

* * * * *

UNITED STATES PATENT AND TRADEMARK OFFICE

CERTIFICATE OF CORRECTION

PATENT NO. : 4,119,360

DATED : October 10, 1978

INVENTOR(S) : Stanley A. Linkowski

It is certified that error appears in the above-identified patent and that said Letters Patent are hereby corrected as shown below:

Add the following to the Abstract:

--In assembling the contact member with the dielectric body, the solder lug is inserted into the preformed opening in the dielectric body through the principal face of the dielectric body until the pin body shoulder stops against the dielectric body, and the spur means slide easily into the preformed opening but positively bitingly engage the dielectric body against withdrawal of the contact member.--

Column 3, line 38, for "medium" read --median--.

Column 3, line 53, for "alongitudinal" read --a longitudinal--

Column 5, line 56, for "sprur" read --spur--.

Column 6, line 8, for "conduct" read --contact--.

Column 8, line 28, insert the following omitted material before "in": as shown on the attached page.

forming each of the spur projections with a sharp tip point spaced from said stop shoulder and extending generally in the same direction as said pin portion projects from said solder lug;

deflecting each of the spur projections from the normal cross sectional shape of the solder lug to an angle of projection which extends diagonally across the plane of one of said broad width surfaces of the solder lug and maintaining the spur projections inside the substantially straight longitudinal edges of the solder lug;

pushing the solder lug into assembly with said dielectric body comprising inserting said solder lug free end first into said hole through said entry end and comprising camming the spur projections along the major width surface of said hole which opposes said one broad width surface of the solder lug as the solder lug is pushed on through the hole;

continuing the assembly by pushing of the solder lug into said hole until said stop shoulder engages a shoulder at said major face of the dielectric body;

and effecting positive retaining anchoring engagement of said spur projection points with said opposing dielectric body major width hole surface such that the spur points will dig into said surface of the hole and hold the solder lug and thereby the contact member against withdrawal from the dielectric body by forces exerted on the pin portion

Signed and Sealed this

***Third* Day of *July 1979***

[SEAL]

*Attest:*

LUTRELLE F. PARKER

*Attesting Officer* *Acting Commissioner of Patents and Tradem*